United States Patent [19]

Santoiemmo

[11] Patent Number: 4,867,209

[45] Date of Patent: Sep. 19, 1989

[54] PORTABLE HAND HOLDABLE CARBONATING APPARATUS

[75] Inventor: Carl V. Santoiemmo, Gates Mills, Ohio

[73] Assignee: United Soda, Inc., Mentor, Ohio

[21] Appl. No.: 114,577

[22] Filed: Oct. 29, 1987

[51] Int. Cl.[4] ..... B01F 3/04; C02D 1/00; B65B 3/04

[52] U.S. Cl. ..... 141/19; 141/17; 141/98; 141/329; 141/351; 261/DIG. 7; 99/323.1; 99/323.2

[58] Field of Search ..... 141/1, 4, 5, 98, 17–20, 141/329, 330, 351, 352, 360; 261/DIG. 7; 99/323.1, 323.2

[56] References Cited

U.S. PATENT DOCUMENTS

| | | | |
|---|---|---|---|
| 1,263,278 | 4/1918 | Parker | 141/177 |
| 1,905,986 | 4/1973 | Jacobs et al. | 141/17 X |
| 2,705,578 | 4/1955 | Burns | 141/17 |
| 2,805,846 | 9/1957 | Dewan | 261/121.1 |
| 4,316,409 | 2/1982 | Adams et al. | 261/DIG. 7 |
| 4,457,877 | 7/1984 | Love et al. | 261/DIG. 7 |
| 4,479,520 | 10/1984 | Holben | 141/1 |
| 4,481,986 | 11/1984 | Meyers | 141/4 |
| 4,610,282 | 9/1986 | Brooks et al. | 141/46 |
| 4,679,602 | 7/1987 | Hollis et al. | 141/19 |

*Primary Examiner*—Ernest G. Cusick

*Attorney, Agent, or Firm*—Torolli, Sundheim & Covell

[57] ABSTRACT

A portable hand holdable apparatus is provided for use in carbonating beverages. The apparatus includes a valve housing having an inlet section adapted to be coupled in a fluid tight engagement with a source or pressurized carbon dioxide and an outlet section adapted to be coupled in fluid tight engagement with a container having beverage therein to be carbonated. A valve structure is mounted within the housing intermediate the inlet section and the outlet section. The inlet section carries a gas release mechanism for cooperating with a source of pressurized carbon dioxide to release carbon dioxide so as to flow into the valve structure. The valve structure includes a first valve for passing carbon dioxide from the inlet section together with a pressure regulator mechanism that responds to the pressure within the outlet section reaching a given level and then blocking further passage of carbon dioxide through the valve structure. This regulates the pressure in the outlet section and, hence, the pressure in the container at a desired pressure level.

32 Claims, 4 Drawing Sheets

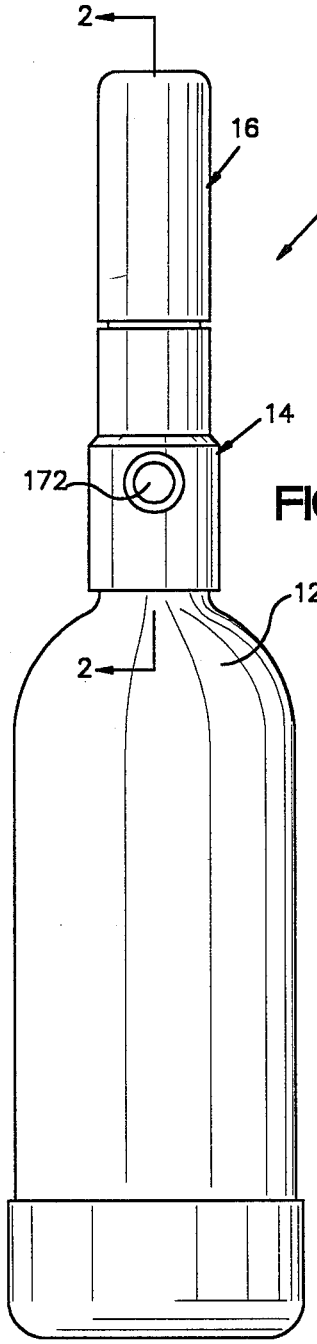
FIG.1
FIG.2
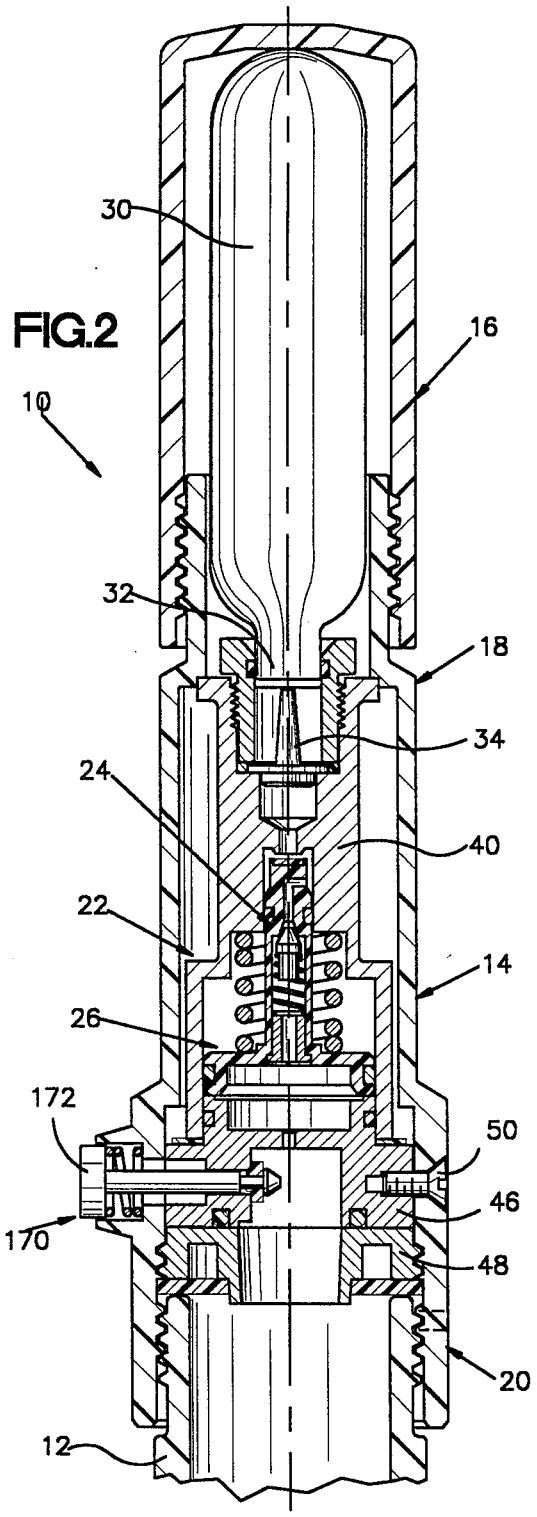

PORTABLE HAND HOLDABLE CARBONATING APPARATUS

BACKGROUND AND SUMMARY OF THE INVENTION

This invention relates to the art of carbonating beverages and, more particularly, to a portable, hand holdable carbonating apparatus intended for domestic use.

Carbonators for domestic use have been known in the prior art. They provide the homemaker with an inexpensive means of carbonating beverages, such as soft drinks, juices, bottled water and the like.

Typically, such domestic carbonators employ a pressurized carbon dioxide cartridge which has a seal at one end that is pierced to release the gas into a special pressure container for carbonating beverage located in the container. Since the gas within the cartridge may be on the order of 1700 p.s.i., the pressure container used for carbonizing the beverage therein is usually a heavy, thick walled, container capable of withstanding such high pressure.

It would be preferable that such domestic carbonators be employed with inexpensive, relatively thin walled light weight containers. Such containers, for example, include thin walled plastic, two liter and three liter containers constructed of flexible plastic materials. However, such thin walled light weight containers would burst if a $CO_2$ cartridge is discharged directly into the container. Such containers may withstand pressures up to approximately 250 p.s.i. For a safety factor on the order of 3:1 it would be preferable, then, that the gas entering the container be on the order of 70 p.s.i.

One attempt in the prior art to provide a device for carbonating beverages employing commercially available containers is presented in the L. Dewan, U.S. Pat. No. 2,805,846. Dewan proposes that a $CO_2$ cartridge be mounted on top of a commercial bottle with a piercing device located within the bottle to pierce the cartridge and direct $CO_2$ gas into the beverage within the container. A valve in the sense of a rubber stopper is mounted on the top of the bottle and is held in place with a spring mechanism so that as gas tends to exceed the pressure rating of the bottle it will escape so as to not burst the bottle. The bottle and the valving mechanism and the cartridge are surrounded by a two-shell construction, including a bottom shell for receiving a portion of the length of the container and a top shell which overlies the top of the container, the cartridge and the spring mechanism holding the stopper in place. This two-piece outer shell is clamped together and as it is tightened in place it causes the cartridge to be forced downwardly into the piercing device to release the gas into the bottle. The outer shell is constructed of material to withstand the pressure of any gas released by the spring biased stopper. Dewan's device, then, is a cumbersome structure not readily usable in a domestic environment for carbonating beverages.

It is desirable to provide a carbonator for carbonating beverages in light weight containers which does not require that the entire apparatus, including the beverage container, the $CO_2$ cartridge and a valving mechanism be mounted within an outer protecting shell structure as in Dewan, supra. It would be desirable to provide a means for regulating the pressure of the gas discharged from the $CO_2$ cartridge into the container having beverage therein to be carbonated.

The E. B. Charpiat, U.S. Pat. No. 2,732,977, discloses a device for carbonating as well as dispensing beverages and which takes the form of a tank provided with compartments, including an ice compartment, a beverage compartment and a pressurized gas supply compartment. Instead of a cartridge, there is provided a tank containing pressurized $CO_2$ together with a valve mechanism which controls the pressure of gas released. The gas is directed by means of tubing into the beverage compartment for purposes of carbonating the beverage therein. Such a structure, while providing pressure regulation, does not lend itself for use as a portable hand holdable carbonator suitable for domestic usage.

It is, therefore, a primary object of the present invention to provide a hand holdable portable domestic carbonator for carbonating beverages wherein a thin walled container, having beverage to be carbonated, receives carbon dioxide at a controlled pressure substantially less than the pressure limits of the container.

It is a still further object of the present invention to provide such a carbonator which does not require the use of an outer shell structure, as in Dewan, supra, which encompasses the carbonator and container.

It is a still further object of the present invention to provide such a carbonator which does not require a structure of the nature disclosed in Charpiat, supra.

In accordance with the present invention, there is provided a portable hand holdable apparatus for use in carbonating beverages and which includes a valve housing that has an inlet section and an outlet section. The inlet section is adapted to be coupled in a fluid tight engagement with a source of pressurized carbon dioxide. The outlet section is adapted to be coupled to a container in fluid tight engagement for discharging carbon dioxide into the container having a beverage therein to be carbonated. A valving means is mounted within the housing intermediate the inlet section and the outlet section. This valving means includes a first valve for use in passing pressurized carbon dioxide received at the inlet section from a source of carbon dioxide. A pressure regulator is located intermediate the first valve and the outlet section and responds to pressure within the outlet section reaching a given pressure level, such as on the order of 70 p.s.i. for blocking further passage of carbon dioxide into the valving means. In this way, the pressure of the carbon dioxide entering the container having beverage therein to be carbonated is regulated at a level substantially below the pressure rating for the container. This, then, permits the use of thin walled containers which have a pressure rating substantially below that of the pressure level within the source of pressurized carbon dioxide.

BRIEF DESCRIPTION OF THE DRAWINGS

The foregoing and other objects and advantages of the invention will become more readily apparent from the following description of the invention as taken in conjunction with the accompanying drawings which are a part hereof and wherein:

FIG. 1 is an elevational plan view illustrating a preferred embodiment of the invention wherein a carbonator is attached to a bottle which may contain a beverage to be carbonated;

FIG. 2 is an enlarged sectional view taken along line 2—2 looking in the direction of the arrows of FIG. 1;

DESCRIPTION OF PREFERRED EMBODIMENT

Figure 3:
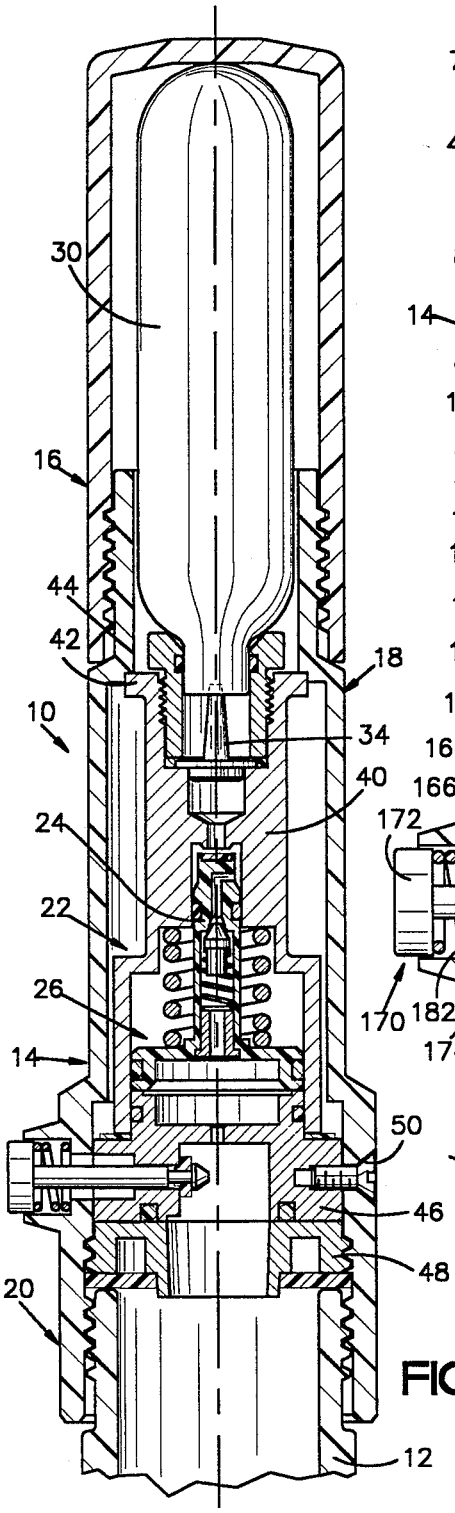
FIG. 3 is a view similar to that of FIG. 2 but showing the carbonator cap screwed tightly down causing the $CO_2$ cartridge to be pierced by a needle.

Reference is now made to the drawings wherein the showings are for purposes of illustrating a preferred embodiment only and not for limiting the same. Reference is now made to FIG. 1 wherein a carbonator 10 constructed in accordance with the present invention is mounted on a two liter plastic bottle 12 which may have a quantity of beverage therein to be carbonated. Although commercial plastic bottles may be employed, it is preferred to use a two liter plastic bottle having an oversized neck opening. For example, the typical two liter commercial plastic bottle in widespread use today has a neck opening on the order of 28 millimeters. To minimize spillage while making the carbonated beverage, it is preferable to provide a bottle having a slightly larger opening, such as on the order of 38 millimeters which is normally used in a three liter bottle. Preferably, bottle 12 has a neck opening on the order of 38 millimeters and has the capacity to contain two liters of beverage to be carbonated.

As best shown in FIG. 2, the neck of bottle 12 has threading on its exterior wall for receiving a cap to maintain the pressure within the bottle once the carbonating process has been completed. The carbonator 10 includes a valve housing 14 and a valve housing cap 16 both constructed of any suitable material such as plastic. The valve housing 14 has an inlet section 18 for receiving a source of pressurized carbon dioxide ($CO_2$). The valve housing has an outlet section 20 adapted to be secured to a container, such as bottle 12 containing a beverage to be carbonated by $CO_2$ gas. A valve assembly 22 is located within the tubular valve housing 14 intermediate inlet section 18 and the outlet section 20. This valve assembly includes a poppet valve 24 and a pressure regulator 26. As will be explained in greater detail hereinafter, a pressurized $CO_2$ cartridge supplies carbon dioxide at a pressure on the order of 1700 p.s.i. into the valve assembly 22 when the cartridge seal is pierced by a needle 34 located at the inlet section of the valve housing. This high pressure $CO_2$ gas is directed into the valve housing so as to open the poppet valve 24 permitting the gas to be directed through the valve housing and, thence, into the outlet section 20 and into the bottle 12 containing beverage to be carbonated. The pressure regulator 26 is responsive to the gas pressure within the outlet section 20 and when the pressure obtains a level on the order of 70 p.s.i., the regulator operates to prevent further passage of gas through the valve housing. In this manner, the pressure of the gas within bottle 12 is maintained at 70 p.s.i. providing a better than 3:1 safety ratio as the typical thin wall plastic bottle 12 can withstand pressure up to a level on the order of 250 p.s.i. The manner in which the valve assembly including the pressure regulator 26 operates will be described in greater detail hereinafter.

Reference is now made more specifically to FIGS. 3–6 which illustrate the preferred embodiment of the invention in greater detail. The valve housing 14 may be constructed of a molded plastic to form a somewhat elongated tubular structure, as is seen in the drawings. The inlet section 18 is necked inwardly and is threaded on its outer surface for receiving an inwardly threaded cap 16. Cap 16 may also be constructed of molded plastic so as to be cylindrical in shape and is of a size sufficient to receive a commercial $CO_2$ cartridge 30 having approximately 16 grams of $CO_2$ therein at a pressure on the order of 1700 p.s.i.

Within the valve housing 14 there is carried a valve body 40 constructed of metal, which at its forward end has an annular outwardly extending flared edge 42. The flared edge in assembly rests against an inwardly extending shoulder 44 of the valve housing 14. The valve body is held in place against shoulder 44 by means of a valve body retainer 46 and a threaded retainer 48. The threaded retainer 48 is an annular member having threads on its outer periphery for engagement with the inner threads on the outlet section 20 so that the retainer 48 may be threaded up against the valve body retainer 46 which, in turn, holds the valve body 40 up against the annular shoulder 44 of the valve housing 14. A suitable screw 50 is threaded through the valve housing 14 into the valve body retainer 46 to hold the parts in place, as well as to maintain proper alignment of various parts that make up the valve assembly.

Figure 4:
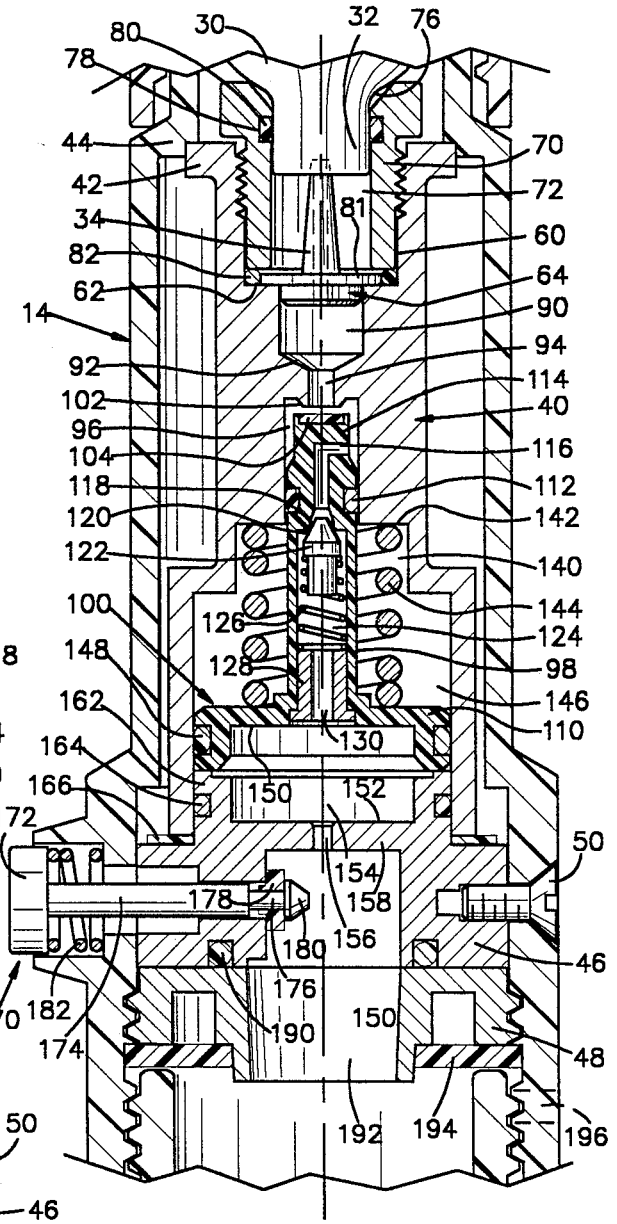
FIG. 4 is an enlarged sectional fragmentary view taken from FIG. 3.
Figure 6:
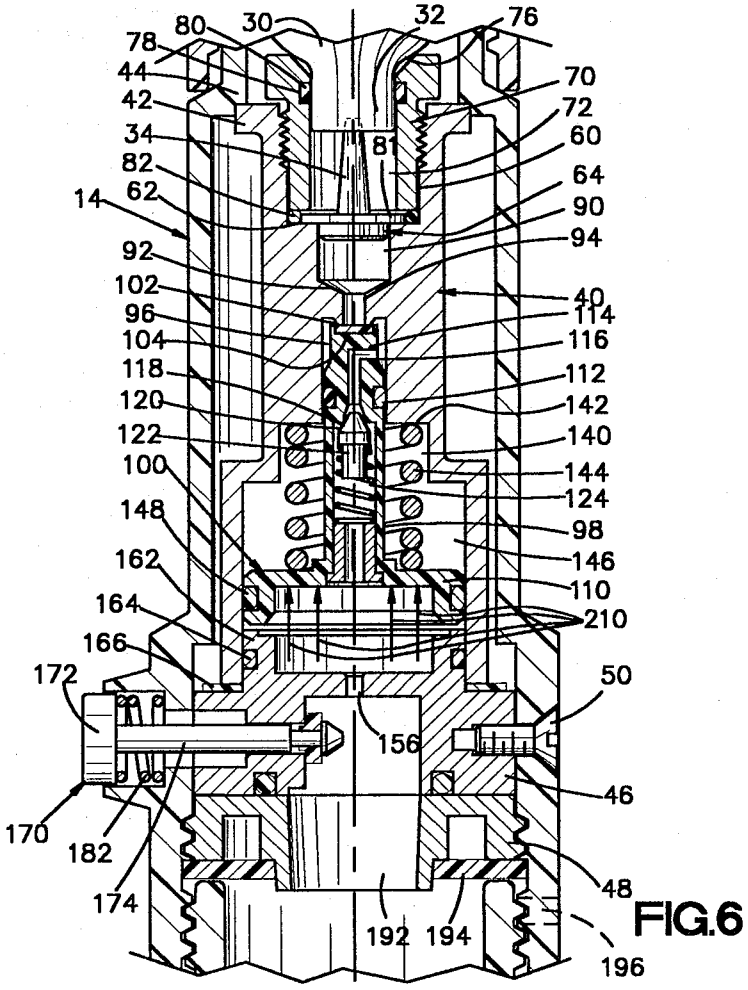
FIG. 6 is a view similar to that of FIG. 5 but showing that the regulator spool has been displaced preventing discharge of $CO_2$ gas into the valving structure.
Figure 5:
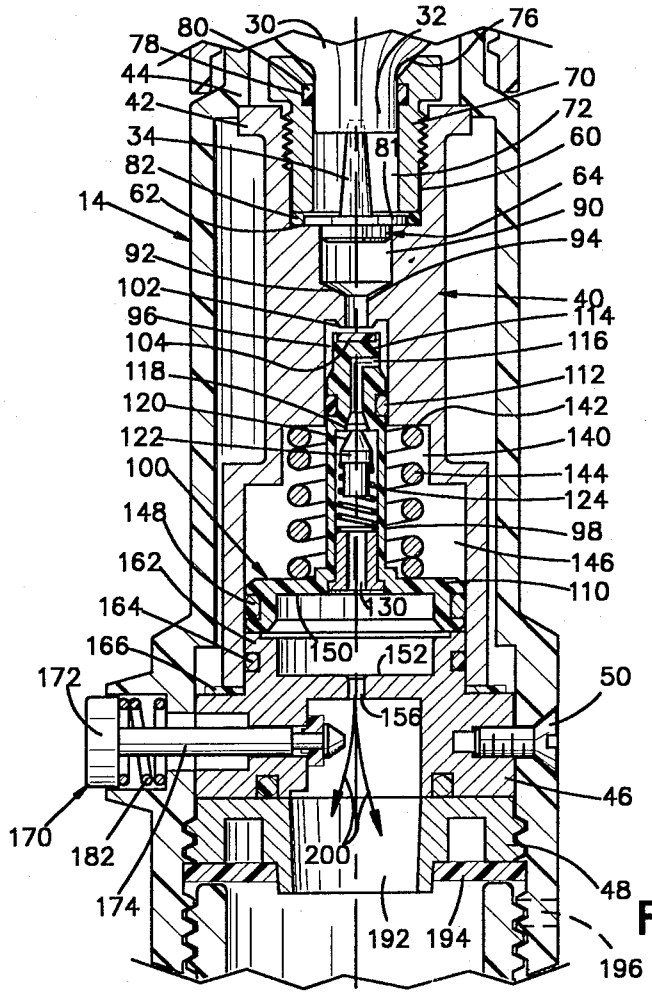
FIG. 5 is a view similar to that of FIG. 4 but showing that a poppet valve has opened.

As best shown in FIGS. 4–6, the inlet end of the valve body has a bore 60 terminating in an annular shoulder 62 which serves to receive cartridge piercing needle assembly 64. The inlet end of bore 60 is threaded so as to receive a threaded needle assembly retainer 70 having a bore 72 therein of sufficient size to receive the neck 32 of the $CO_2$ cartridge 30.

The inlet end of bore 72 in retainer 70 is flared outwardly so as to provide a canted annular shoulder 76 to assist in receiving and guiding the neck of the cartridge into the bore as well as for providing a stop against which the body portion of the cartridge may rest when the cartridge is in its gas discharging position. To assist in maintaining an airtight seal, retainer 70 has an annular groove 78 formed in the walls of bore 72 near the inlet end thereof for receiving an O-ring 80 of a suitable resilient material which bears against the cylindrical surface the cartridge neck 32 as the cartridge is in place positioned with its neck into bore 72.

The needle assembly 64 includes needle 34 having a longitudinally extending flat side. The needle is otherwise tapered as it extends toward the inlet end of bore 72 and is capable of piercing the seal on the end of the cartridge so that gas within the cartridge may be discharged along the longitudinal flat side on the needle and then passed into the valve body through a radially extending slot in a radially extending flange 81. An O-ring 82 circumferentially surrounds the peripheral edge of the flange 81 and is held in place against shoulder 62 in the inner walls of bore 60 by means of the needle retainer 70 when threaded into place, as is shown in the drawings herein.

A second cylindrical bore 90 coaxial with bore 60 extends into the valve body 40 toward the outlet section and this bore, which is of a smaller diameter than bore 60, terminates in an inwardly conically flanged shoulder 92. A third bore 94 of substantially smaller diameter than that of bore 90 and coaxially therewith extends from bore 90 into a bore 96. Bore 96 is coaxial with, but is of greater diameter than bore 94, and serves to receive a portion of the length of a valve stem 98 of a valve spool 100. Bore 96 has a raised annular shoulder 102 that coaxially surrounds bore 94 as it enters into the space provided by bore 96. One end of the stem 98 has a circular recess formed therein and carries a resilient disc 104 which, as is shown in FIG. 6, may engage the annular shoulder 102 and block passage of $CO_2$ from bore 94 into bore 96 when the valve spool 100 is displaced, as viewed in FIG. 6. This takes place during the regulating operation of the pressure regulator.

The valve spool 100 includes a cylindrical section of valve stem 98 which extends from a base member in the form of a circular disc 110. The valve stem 98 and disc 110 may be integral and constructed of plastic material. The outer diameter of stem 98 for most of its length is slightly less than that of bore 96 so that the valve stem may be slidably received by the bore. Near the inlet end of valve stem 98 there is provided an annular groove for receiving an resilient O-ring 112 which makes engagement with the groove in the valve stem as well as with the inner walls of bore 96 as the valve stem slides back and forth within the bore. Forwardly of the O-ring 112, toward the inlet section, the outer diameter of the valve stem 98 is reduced at the stem end section 114 so as to provide a chamber through which $CO_2$ gas may enter bore 96. The end section 114 also is provided with an L-shaped passageway 116 which extends radially into the interior of the valve stem and then extends toward the outlet section terminating in an outwardly flared poppet valve seat 118. This valve seat 118 receives the inwardly tapered portion 120 of a poppet 122. This poppet 122 and the valve seat 118 form the poppet valve 24 discussed hereinbefore with reference to FIG. 2. The poppet 122 is located in a bore 124 which extends within the valve stem 98 through the disc 110. The poppet 122 is held in place against valve seat 118 by means of a coil compression spring 126 and which, in turn, is held in place by means of a poppet valve retainer 128 which extends into the bore 124 and suitably held in place within the bore. The retainer 128 has a bore 130 extending therethrough toward the outlet section so that $CO_2$ gas passed by the poppet valve 24 will enter bore 124 and thence flow through bore 130 toward the outlet section.

The valve body has a bore 140 terminating in a shoulder 42 intermediate bore 140 and bore 96. This bore 140 is of a substantially greater diameter than that of bore 96 and is sufficient to receive a coil spring 144 which coaxially surrounds a portion of the length of valve stem 98 with the spring being retained in place between shoulder 142 and valve disc 110. This compression spring serves to normally hold the valve disc 110 in place up against valve body retainer 46 so that inlet end of the valve stem is longitudinally spaced from shoulder 102, surrounding bore 94, permitting $CO_2$ gas to flow into bore 96 as discussed hereinbefore.

The valve disc 110 is of substantially greater diameter than that of the coil spring 144 and is mounted for reciprocal movement within the larger bore 146 at the outlet end of valve body 40. The disc 110 has an annular groove about its periphery for receiving an O-ring 148 which is resiliently biased between the groove and the inner walls of bore 146 to provide a sealing action as the valve spool assembly is displaced. The outlet side of the disc 110 is recessed so as to provide a large pressure responsive surface 150, to be described in greater detail hereinafter in conjunction with the operation of the pressure regulator. This recessed surface 150 faces a recessed surface 152 in the valve body retainer 46, providing therebetween a pressure chamber 154. Gas within this pressure chamber 154 is permitted to discharge into the outlet section by means of a passageway 156 which extends through the valve body retainer wall 158 that separates chamber 154 from an outlet chamber 160. The outlet chamber 160 may be a bore that is provided in the valve body retainer 46 in coaxial alignment with the passageway 156 and chamber 154. The valve body retainer 46 has a cylindrical sleeve portion 162 that is received within a portion of the outlet end of bore 146 in the valve body 40. This sleeve portion 162 has an annular groove in its outer surface and this groove receives an O-ring 164 which is resiliently biased between the groove in the sleeve portion 162 and the inner walls of bore 146 at the outlet end thereof. A resilient valve washer 166 coaxially surrounds a portion of the cylindrical section 162 and is located intermediate the outlet end of the valve body 40 and valve body retainer 46. These O-rings 148, 164 and washer 166 help to insure that gas is not released during the carbonating operation.

A pressure relief valve 170 is carried by the valve housing 14 and this includes a push button 172 having a valve stem 174 which extends through bores in the valve housing 14 and in the retainer 46 with the distal end of the stem having a reduced diameter portion 176 which carries a valve seal 178. The seal 178 coaxially surrounds portion 176 and is held in place by an end button 180. A coil spring 182 coaxially surrounds a portion of stem 174 to resiliently hold the relief valve in a closed position. The valve may be opened by manually depressing button 172 against the resilient force of spring 182 permitting gas in chamber 160 to escape. This is typically done after a carbonation operation has been completed, but before the bottle has been disconnected from the carbonator 10.

The outlet facing surface of valve body retainer 46 is provided with an annular groove which coaxially surrounds chamber 160 and this groove receives an O-ring 190 which, in assembly, is resiliently biased against the groove and the facing surface of the threaded retainer 48 to prevent leakage of gas from the chamber 160 during operation.

The threaded retainer 48 has a bore 192 in coaxial alignment with chamber 160. This retainer carries an annular bottle seal 194 which may take the form of a resilient washer which, in assembly, is in engagement with the inner walls of the outlet end of the valve housing and the open end of the bottle 12 so as to maintain a pressure seal. A safety relief port 196 extends radially through a threaded portion of the outlet section 20 of the valve housing 14 to provide pressure relief in the event an operator fails to release the pressure relief valve 170 prior to removing the bottle 12 from the carbonator. Thus, this allows for the pressure to be released by way of port 196 before the threads become disengaged.

In operation, an operator will attach the carbonator 10 to a bottle 12 containing liquid to be carbonated. The $CO_2$ cartridge will be inserted into the inlet section 18 of the valve housing so that the neck 32 of the cartridge is guided into bore 72 of the retainer 70. The valve housing cap 16 is then threaded onto the inlet end of the valve housing until the inner end surface of the inner wall of the cap engages the bottom end of the cartridge 30. This is the condition as shown in FIG. 2. As the cap 16 is threaded further onto the inlet end of the valve housing, the cartridge 30 is forced into the piercing needle 34 causing the needle to pierce the seal on the cartridge, permitting gas to escape from the cartridge. Gas will then pass into bore 72 and thence through a slot extending through flange 81 and will pass into bore 90, 94 and into bore 96. Gas is prevented from being discharged into the cap by virtue of the O-rings 80 and 82. Gas in bore 96 is prevented from escaping into bores 140 and 146 by virtue of O-ring 112. Thus, the gas enters the L-shaped passageway 116 in the valve stem 98 causing the poppet valve 24 to open as the poppet 122 is forced back against the relatively light force of spring 126. The pressure required to open the poppet valve may be on the order of 5 p.s.i.

With the poppet valve being opened, gas will now flow through the valve structure by way of bore 124 in the poppet stem 98 and thence through bore 130 in the poppet retainer 128. Gas will then enter chamber 154 and, thence, flow as indicated by the arrows 200 through the passageway 156 in wall 158 into the pressure chamber 160 and, thence, into the bottle 12 for carbonating the beverage therein.

The gas will continue to flow into the bottle 12 until the pressure attains a level on the order of 70 p.s.i. At that time, the pressure will exert force, as indicated by the arrows 210 in FIG. 6, which acts against the recessed surface 150 in the disc 110 causing the valve spool assembly 100 to be displaced (as viewed in FIG. 6) against the resisting force of the coil spring 144. The insert 104 on the end of the valve stem 98 will engage the shoulder 102 surrounding bore 94, preventing further discharge of gas into the valve structure. The pressure must be sufficient to overcome the resistance of coil spring 144 as well as the pressure of the gas discharging through bore 94 acting against the insert 104 at the end of the valve stem 98. As gas is absorbed into the liquid within the bottle 12, the pressure acting against disc 110 will be reduced somewhat permitting the valve spool assembly to shift back, as viewed in FIG. 6, once again opening the valve so that the gas may pass into the valve assembly by way of the L-shaped passageway 116. Manually shaking the assembly will assist in the gas being absorbed by the beverage.

When all of the gas has been absorbed, the valve spool assembly will become balanced and return to the position as indicated in FIG. 4. The carbonator may now be removed from the two-liter bottle 12. However, because there may still be some pressure acting against the bottle seal washer 194, the pressure release button 172 should be depressed, allowing the pressure in chamber 160 to drop so the carbonator may be safely removed. In the event the operator fails to depress the pressure release button 172, the gas will escape by way of the safety relief port 196 before the threads become disengaged, thereby serving to prevent an accidental blow off.

Figure 7:
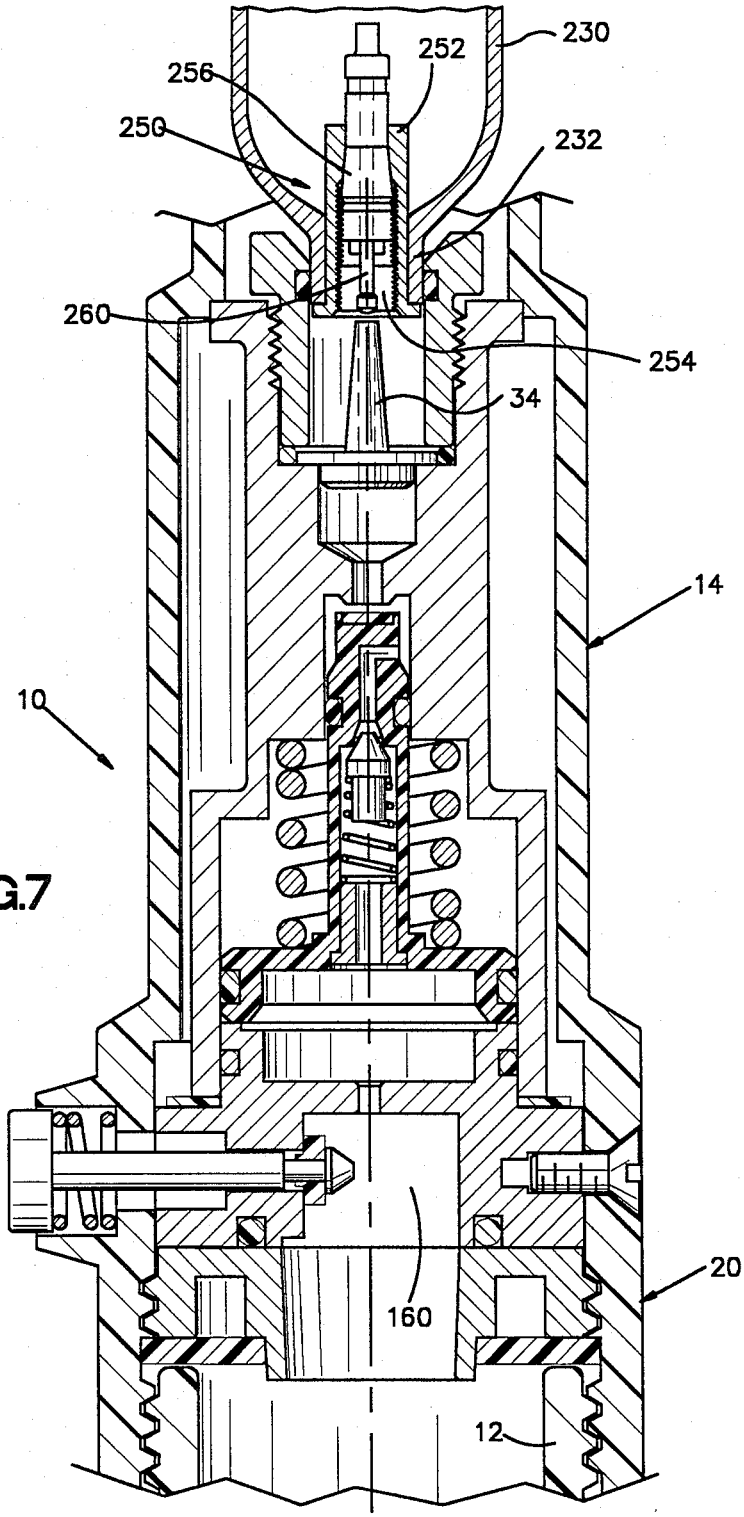
FIG. 7 is an enlarged fragmentary view similar to that of FIG. 2 but showing the carbonator being used in conjunction with a $CO_2$ cartridge having a spring biased valve stem as opposed to the $CO_2$ cartridge having a seal at one end, as in FIGS. 2–6.

Reference is now made to FIG. 7 which illustrates another embodiment of the invention. The carbonator 10 of FIG. 7 is identical to that described hereinbefore and like components are identified with like character references. In this embodiment, there is provided a $CO_2$ cartridge 230 having a neck 232 adapted to be received by the carbonator in the same manner as described hereinbefore. However, the cartridge is not employed with a typical seal at its end, but instead there is provided a valve assembly 250. The valve assembly includes a valve retainer 252 mounted to the open end of the cartridge. The retainer includes an internal threaded bore 254 to which there is threaded a pneumatic valve 256 having an outer threading thereon for engagement with the threading in the bore 254. This valve 256 may take the form of a typical pneumatic air valve, such as a tire valve. This valve has a spring biased valve stem 260 which, when depressed, will release the contents within cartridge 230 so as to escape through the valve and thence into the bore 254. The valve 256 and the valve stem 260 are oriented so that the end of the valve stem 260 will make engagement with needle 34 in such manner that as the cap 16 is screwed in place, the needle will depress the valve stem 260 sufficient to release gas from the cartridge. Otherwise, the operation of this embodiment is the same as that discussed hereinbefore.

Although the invention has been described in conjunction with preferred embodiments, it is to be appreciated that various changes in components may be made within the spirit and scope of the invention as defined by the appended claims.

Having described specific preferred embodiments of the invention, the following is claimed:

1. A portable hand holdable apparatus for use in carbonating beverages comprising:

an elongated tubular valve housing having tubular walls coaxially surrounding a central axis, said tubular valve housing having an inlet section and an outlet section;

said inlet section having means for coupling said housing in a fluid tight engagement with a source of pressurized carbon dioxide;

said outlet section having means for coupling said housing in a fluid tight engagement with a container having a beverage therein to be carbonated;

a valve assembly completely mounted within said housing intermediate said inlet section and said outlet section;

gas release means mounted in said inlet section and adapted for cooperation with a said source for releasing carbon dioxide gas therefrom so as to flow in a direction coaxial of said axis into said valve assembly;

said valve assembly including first valve means for passing carbon dioxide gas received from said gas release means so it may flow in a direction coaxial of said axis into said valve assembly; and said valve assembly including pressure regulator means responsive to the pressure acting in a direction coaxial of said axis reaching a given level and then blocking passage of carbon dioxide gas through said valve assembly so as to thereby regulate the pressure in said outlet section as well as in a said container at said given level.

2. Apparatus as set forth in claim 1 wherein said valve assembly includes a valve body extending between said inlet section and said outlet section, said valve body having an inlet end and an outlet end having bore means coaxial of said axis extending longitudinally therethrough between said ends so that gas entering said inlet end my be transmitted through said valve body to the outlet end thereof.

3. Apparatus as set forth in claim 2 wherein said gas release means is mounted to the inlet end of said valve body for releasing gas into said bore means.

4. Apparatus as set forth in claim 3 wherein said gas release means includes a needle like member located within said inlet section and extending outwardly thereof in a direction coaxial of said axis toward said source of pressurized carbon dioxide, said source of pressurized carbon dioxide taking the form of a cartridge aligned coaxial with said axis and having a seal at one end which may be pierced by said needle like member for releasing gas into said bore means.

5. Apparatus as set forth in claim 3 wherein said first valve means is mounted within said bore means in said valve body intermediate said gas release means and said outlet section.

6. Apparatus as set forth in claim 5 wherein said pressure regulator means is mounted within said valve body intermediate said first valve means and said outlet section

7. Apparatus as set forth in claim 6 wherein said regulator means includes a disc member mounted for reciprocal movement in a direction coaxial with said axis in said bore means, said disc member having a first surface perpendicular to said axis and which faces said outlet section against which forces due to pressure in said outlet section may act to cause movement of said disc member in a first direction.

8. Apparatus as set forth in claim 7 including means for resisting movement of said disc member in said first direction until the gas pressure in said outlet section attains a given level.

9. Apparatus as set forth in claim 8 wherein said means for resisting includes spring means for resiliently urging said disc member in a direction opposite to said first direction.

10. Apparatus as set forth in claim 9 including means for blocking passage of gas through said bore means in response to movement of said disc member by a given amount in said first direction.

11. Apparatus as set forth in claim 10 wherein said means for blocking includes a stem member coaxial of said axis and extending from said disc member toward said inlet section for reciprocal movement within said bore means as said disc member undergoes reciprocal movement in said bore means.

12. Apparatus as set forth in claim 11 wherein said bore means in said valve body includes a first bore for receiving gas being passed by said gas release means and a second bore spaced intermediate said first bore and said outlet section for receiving at least a portion of the length of said stem member for reciprocal movement therein, the second bore having a greater diameter than that of said first bore and being adjacent thereto.

13. Apparatus as set forth in claim 12 wherein said stem member has a distal end of greater diameter than said first bore and which normally faces and is spaced from said first bore, said distal end adapted to engage and close said first bore when said disc member is displaced by said given amount in said first direction by the gas pressure in said outlet section so that when the gas pressure in said outlet section attains said given level the first bore is closed preventing further passage of gas from said gas release means into said second bore.

14. A portable hand holdable apparatus for use in carbonating beverages, comprising:

a valve housing having an inlet section and an outlet section;

said inlet section having means for coupling said housing in a fluid tight engagement with a source of pressurized carbon dioxide;

said outlet section having means for coupling said housing in a fluid tight engagement with a container having a beverage therein to be carbonated;

a valve assembly mounted within said housing intermediate said inlet section and said outlet section;

gas release means mounted in said inlet section and adapted for cooperation with said source for releasing carbon dioxide gas therefrom so as to flow into said valve assembly;

said valve assembly including first valve means for passing carbon dioxide gas received from said gas release means so that it may flow into said valve assembly;

said valve assembly including pressure regulator means responsive to the pressure within said outlet section reaching a given level and then blocking passage of carbon dioxide gas through said valve assembly so as to thereby regulate the pressure in said outlet section as well as in a said container at said given level;

said valve assembly includes a valve body extending between said inlet section and said outlet section, said valve body having an inlet end and an outlet end and having bore means extending longitudinally therethrough between said ends so that gas entering said inlet end may be transmitted through said valve body to the outlet end thereof;

said gas release means is mounted to the inlet end of said valve body for releasing gas into said bore means;

said first valve means is mounted within said bore means in said valve body intermediate said gas release means and said outlet section;

said pressure regulator means is mounted within said valve body intermediate said first valve means and said outlet section;

said regulator means includes a disc member mounted for reciprocal movement in said bore means, said disc member having a first surface which faces said outlet section against which forces due to pressure in said outlet section may act to cause movement of said disc member in a first direction;

means for resisting movement of said disc member in said first direction until the gas pressure in said outlet section attains a given level;

said means for resisting includes spring means for resiliently urging said disc member in a direction opposite to said first direction;

means for blocking passage of gas through said bore means in response to movement of said disc member by a given amount in said first direction;

said means for blocking includes a stem member extending from said disc member toward said inlet section for reciprocal movement within said bore means as said disc member undergoes reciprocal movement in said bore means;

said bore means in said valve body includes a first bore for receiving gas being passed by said gas release means and a second bore spaced intermediate said first bore and said outlet section for receiving at least a portion of the length of said stem member for reciprocal movement therein, the second bore having a greater diameter than that of said first bore and being adjacent thereto;

said stem member has distal end of greater diameter than said first bore and which normally faces and is spaced from said first bore, said distal end adapted to engage and close said first bore when said disc member is displaced by said given amount in said first direction by the gas pressure in said outlet section so that when the gas pressure in said outlet section attains said given level the first bore is closed preventing further passage of gas from said gas release means into said second bore; and wherein said stem member has a third bore in communication with said second bore and which extends longitudinally within said stem member toward said disc member.

15. Apparatus as set forth in claim 14 wherein said stem member has a fourth bore in communication with said third bore and of greater diameter than said third bore and extends through said disc member toward said outlet section.

16. Apparatus as set forth in claim 15 wherein said first valve means includes a poppet valve mounted within said fourth bore so as to normally close said third bore and being responsive to carbon dioxide gas flowing into said third bore for opening so as to allow said gas to pass into said fourth bore toward said outlet section.

17. Apparatus as set forth in claim 14 including a pressure release valve means carried by said valve housing and extending into said outlet section for releasing gas therefrom.

18. Apparatus as set forth in claim 17 including a safety release passageway extending through said valve housing at said outlet section thereof for releasing gas from said outlet section as a said container is being disengaged from said housing.

19. Apparatus as set forth in claim 14 in combination with said source of pressurized carbon dioxide, said source including a cartridge containing carbon dioxide gas under pressure, said cartridge having a discharge end, pneumatic valve means being mounted within said discharge end and including a spring biased valve stem cooperating with said gas release means so as to be depressed thereby to release gas from said cartridge into said valve assembly

20. A portable, hand holdable apparatus for use in carbonating beverages, comprising:

an elongated tubular housing having tubular walls coaxially surrounding a central axis, said tubular housing having an inlet section and an outlet section;

said inlet section having means for coupling said housing in a fluid tight engagement with a source of pressurized carbon dioxide gas;

said outlet section having means for coupling the housing to a container in a fluid tight engagement for discharging carbon dioxide gas into said container having a beverage therein to be carbonated;

said inlet section having gas release means extending coaxially of said axis for cooperating with said source for releasing carbon dioxide therefrom to flow axially into said housing;

said source of pressurized carbon dioxide being aligned coaxially of said axis and including a cartridge containing carbon dioxide gas under pressure and having a discharge end, pneumatic valve means being mounted within said discharge end and including a spring biased valve stem aligned coaxially of said axis and cooperating with said gas release means so as to be depressed thereby to release gas from said cartridge axially into said housing;

said housing includes a valve assembly completely mounted therein and having a valve body extending between said inlet section and said outlet section, said valve body having an inlet end and an outlet end and having bore means extending longitudinally therethrough between said ends so that gas entering said inlet end may be transmitted axially through said valve body to the outlet end thereof;

said gas release means is mounted to the inlet end of said valve body for releasing gas into said bore means;

first valve means mounted within said bore means in said valve body intermediate said gas release means and said outlet section; and pressure regulator means mounted within said valve body intermediate said first valve means and said outlet section.

21. Apparatus as set forth in claim 20 wherein said regulator means includes a disc member mounted for reciprocal movement in a direction coaxial with said axis in said bore means, said disc member having a first surface perpendicular to said axis and which faces said outlet section against which forces due to pressure in said outlet section may act to cause movement of said disc member in a first direction.

22. Apparatus as set forth in claim 21 including means for resisting movement of said disc member in said first direction until the gas pressure in said outlet section attains a given level.

23. Apparatus as set forth in claim 22 wherein said means for resisting includes spring means for resiliently urging and disc member in a direction opposite to said first direction.

24. Apparatus as set forth in claim 23 including means for blocking passage of gas through said bore means in response to movement of said disc member by a given amount in said first direction.

25. Apparatus as set forth in claim 24 wherein said means for blocking includes a stem member coaxial of said axis and extending from said disc member toward said inlet section for reciprocal movement within said bore means as said disc member undergoes reciprocal movement in said bore means.

26. Apparatus as set forth in claim 25 wherein said bore means in said valve body includes a first bore for receiving gas being passed by said gas release means and a second bore spaced intermediate said first bore and said outlet section for receiving at least a portion of the length of said stem member for reciprocal movement therein, the second bore having a greater diameter than that of said first bore and being adjacent thereto.

27. Apparatus as set forth in claim 26 wherein said stem member has a distal end of greater diameter than said first bore and which normally faces and is spaced from said first bore, said distal end adapted to engage and close said first bore when said disc member is displaced by said given amount in said first direction by the gas pressure in said outlet section so that when the gas pressure in said outlet section attains said given level the first bore is closed preventing further passage of gas from said gas release means into said second bore.

28. A portable, hand holdable apparatus for use in carbonating beverages, comprising:

a housing having an inlet section and an outlet section;

said inlet section having means for coupling said housing in a fluid tight engagement with a source of pressurized carbon dioxide gas;

said outlet section having means for coupling the housing to a container in a fluid tight engagement for discharging carbon dioxide gas into said container having a beverage therein to be carbonated;

said inlet section having gas release means for cooperating with said source for releasing carbon dioxide therefrom to flow into said housing;

said source of pressurized carbon dioxide including a cartridge containing carbon dioxide gas under pressure and having a discharge end, pneumatic valve means being mounted within said discharge end and including a spring biased valve stem cooperating with said gas release means so as to be depressed thereby to release gas from said cartridge into said housing;

said housing includes a valve assembly mounted therein and having a valve body extending between said inlet section and said outlet section, said valve body having an inlet end and an outlet end and having more means extending longitudinally therethrough between said ends so that gas entering said inlet end may be transmitted through said valve body to the outlet end thereof;

said gas release means is mounted to the inlet end of said valve body for releasing gas into said bore means;

first valve means mounted within said more means in said valve body intermediate said gas release means and said outlet section;

pressure regulator means mounted within said valve body intermediate said first valve means and said outlet section;

said regulator means includes a disc member mounted for reciprocal movement in said bore means, said disc member having a first surface which faces said outlet section against which forces due to pressure in said outlet section may act to cause movement of said disc member in a first direction;

means for resisting movement of said disc member in said first direction until the gas pressure in said outlet section attains a given level;

said means for resisting includes spring means for resiliently urging said disc member in a direction opposite to said first direction;

means for blocking passage of gas through said bore means in response to movement of said disc member by a given amount in said first direction;

said means for blocking includes a stem member extending from said disc member toward said inlet section for reciprocal movement within said bore means as said disc member undergoes reciprocal movement in said bore means;

said bore means in said valve body includes a first bore for receiving gas being passed by said gas release means and a second bore spaced intermediate said first bore and said outlet section for receiving at least a portion of the length of said stem member for reciprocal movement therein, the second bore having a greater diameter than that of said first bore and being adjacent thereto;

said stem member has a distal end of greater diameter than said first bore and which normally faces and is spaced from said first bore, said distal end adapted to engage and close said first bore when said disc member is displaced by said given amount in said first direction by the gas pressure in said outlet section so that when the gas pressure in said outlet section attains said given level the first bore is closed preventing further passage of gas from said gas release means into said second bore; and said stem member has a third bore in communication with said second bore and which extends longitudinally within said stem member toward said disc member.

29. Apparatus as set forth in claim 28 wherein said stem member has a fourth bore in communication with said third bore and of greater diameter than said third bore and extends through said disc member toward said outlet section.

30. Apparatus as set forth in claim 29 wherein said first valve means includes a poppet valve mounted within said fourth bore so as to normally close said third bore and being responsive to carbon dioxide gas flowing into said third bore for opening so as to allow said gas to pass into said fourth bore toward said outlet section.

31. Apparatus as set forth in claim 28 including a pressure release valve means carried by said valve housing and extending into said outlet section for releasing gas therefrom.

32. Apparatus as set forth in claim 28 including a safe release passageway extending through said valve housing at said outlet section thereof for releasing gas from said outlet section as a said container is being disengaged from said housing.

* * * * *